US007178772B2

(12) United States Patent
Riker

(10) Patent No.: US 7,178,772 B2
(45) Date of Patent: Feb. 20, 2007

(54) MAILBOX POST BRACKET

(75) Inventor: Ronald D. Riker, Brownwood, TX (US)

(73) Assignee: Caminoverde II, L.L.P., Hutto, TX (US)

( * ) Notice: Subject to any disclaimer, the term of this patent is extended or adjusted under 35 U.S.C. 154(b) by 0 days.

(21) Appl. No.: 10/735,360

(22) Filed: Dec. 12, 2003

(65) Prior Publication Data

US 2005/0127259 A1 Jun. 16, 2005

(51) Int. Cl.
*A47B 96/06* (2006.01)
*A47G 29/00* (2006.01)
*A47K 1/00* (2006.01)

(52) U.S. Cl. ..... 248/219.2; 248/146; 232/39

(58) Field of Classification Search ..... 248/219.2, 248/220.21, 146, 152, 158; 232/38, 39, 17
See application file for complete search history.

(56) References Cited

U.S. PATENT DOCUMENTS 1,602,290 A 10/1926 Taylor
2,552,917 A * 5/1951 Becker ..... 220/787
3,802,656 A * 4/1974 Virblas ..... 248/145
4,236,665 A 12/1980 Glass
4,286,747 A 9/1981 Deike
4,300,739 A 11/1981 Sande
4,403,730 A * 9/1983 Batson ..... 232/39
4,951,905 A 8/1990 Bronson et al.
5,065,975 A 11/1991 Giles
D350,003 S 8/1994 Rentz
5,337,954 A * 8/1994 Kobilarcik et al. ..... 232/38
5,386,938 A 2/1995 West
5,509,603 A 4/1996 Hering
5,664,748 A * 9/1997 Speece et al. ..... 248/219.2
6,047,933 A * 4/2000 Hoover ..... 248/219.2

* cited by examiner

*Primary Examiner*—Amy J. Sterling
(74) *Attorney, Agent, or Firm*—Storm LLP; Mark D. Perdue

(57) ABSTRACT

A mailbox bracket comprises a laminar plate that is generally coextensive with a lower surface of the mailbox and has a pair of flanges for securing the mailbox to the plate. A generally cylindrical sleeve is secured to the plate and extends downwardly therefrom. The sleeve is adapted to receive a generally cylindrical post and includes an aperture for use with a bolt or pin to secure the post within the sleeve.

6 Claims, 3 Drawing Sheets

MAILBOX POST BRACKET

BACKGROUND OF THE INVENTION

1. Field of the Invention

The present invention relates generally to mailboxes for use adjacent roadways. More particularly, the present invention relates to the bracket used to secure a conventional mailbox to the post on which it is mounted.

2. Summary of the Prior Art

For decades, the mailbox has been a familiar sight along the roadways of America, particularly along rural roads and highways. Because these mailboxes are typically arranged only a few feet from the edge of the roadway, highway authorities often prescribe regulations dealing with the construction of such mailboxes. The design of the mailbox itself is prescribed by the postal authorities, i.e. the United States Postal Service (USPS).

Due to their location adjacent roadways, mailboxes and other roadside features often are struck in roadway accidents, making their construction to be "crash worthy" an issue of some importance. The National Cooperative Highway Research Program has promulgated standards for the safety evaluation of highway features such as signs and sign supports in Report 350. The standards set forth in Report 350 relate to the behavior of highway features when struck by a vehicle. The desired behavior is that the sign or other feature fail in such a way that property damage and personal injury are minimized to the extent possible. Thus, the terms "crashworthiness" and "crash worthy," as used herein, actually mean susceptibility to failure in the event of a crash or collision, rather than resistance to failure. The standards and testing methodologies contained in Report 350 have been adopted by most states. Therefore, the majority of roadside signs and features are made in consideration of, if not in compliance with, the standards of Report 350.

Consistent with this concern over the construction of roadside features, it is typical for a mail customer who intends to place a mailbox by the roadside to apply to the local office of the highway regulation authority for permission to place the box. In some states, the authorities themselves provide the post and install a USPS-approved mailbox on an approved, crash worthy post in what the authorities deem a safe location and in a safe fashion.

The conventional mailbox and post assembly, including the bracket, when struck by a vehicle, sometimes exhibits a mode of failure in which the mailbox detaches from the post and can come through the windshield of the vehicle, thereby posing a grave risk to the occupants of the vehicle in what otherwise might be a relatively minor accident.

A need exists for both posts and brackets for securing the mailbox to the post that are easily and inexpensively manufactured and fail in a relatively safe or crash worthy mode in the event of an accident.

SUMMARY OF THE INVENTION

It is a general object of the present invention to provide an improved bracket for securing a mailbox to a support post that is circular in cross-section.

This and other objects of the present invention are achieved by providing a bracket comprising a laminar plate that is generally coextensive with a lower surface of the mailbox and has means for securing the mailbox to the plate. A generally cylindrical sleeve is secured to the plate and extends downwardly therefrom. The sleeve is adapted to receive a generally cylindrical post and includes means for securing the post within the sleeve.

According to the preferred embodiment of the present invention, the laminar plate is rectangular and has a pair of long edges.

According to the preferred embodiment of the present invention, the means for securing the mailbox to the plate further comprises a flange on each of the long edges of the plate extending generally perpendicular to the plate and at least one fastener securing the flange to a corresponding flange on the mailbox. The fastener may be a nut and a bolt.

According to the preferred embodiment of the present invention, the means for securing the post within the sleeve further comprises an aperture formed through the sleeve and the post and a bolt extending through the aperture, thereby securing the sleeve against movement relative to the post.

According to the preferred embodiment of the present invention, the plate is provided with a plurality of lightening holes.

DETAILED DESCRIPTION OF THE INVENTION

Figure 1:
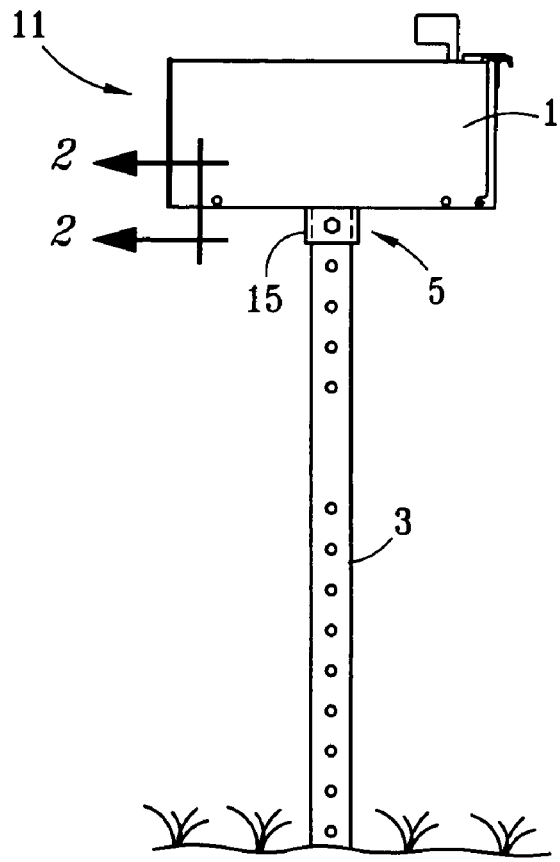
FIG. 1 (PRIOR ART)
FIG. 1 is an elevation view of a mailbox of the type with which the present invention is contemplated for use, illustrating a prior-art post and bracket.
Figure 2:
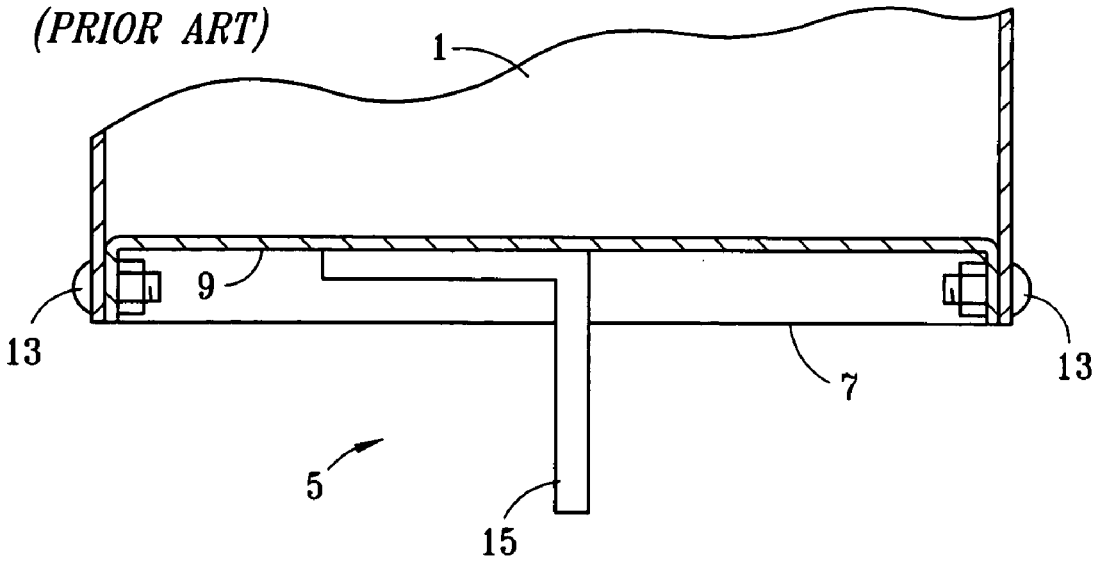
FIG. 2 (PRIOR ART)
FIG. 2 is a partial section view, taken along section line 2—2 of FIG. 1, illustrating the prior-art bracket.

Referring now to the Figures, and particularly to FIGS. 1 and 2, a prior-art mailbox assembly 11 is illustrated. The assembly comprises a mailbox 1, which is commonly available and made to USPS standards. Mailbox 1 is secured atop a post 3, which conventionally is provided by the highway regulation authorities. In this case, post 3 that is illustrated is formed of steel and has a plurality of holes along its length. Mailbox 1 is secured atop post 1 by means of a bracket 5, which is illustrated in greater detail in FIG. 2.

Bracket 5 has a generally flat, rectangular plate 7 that is generally coextensive with bottom 9 of mailbox 1. Plate 7 has a pair of upwardly extending flanges 13 along its long edges. Flanges 13 mate with corresponding downwardly turned flanges on mailbox 1, and nuts, screws, or rivets are used to secure the two together. A steel L-shaped bracket 15 is secured, typically by bolts, to the bottom of plate 7 and extends downwardly to permit bracket 5 and mailbox 1 to be secured by bolts to post 3. This bracket is satisfactory in most respects, except that it has been observed that a fairly typical failure mode for this design, in the event of a collision with a vehicle, is for mailbox 1 to shear off of bracket 5 in a plane parallel to plate 7 and bottom 9 of mailbox 1. When this occurs, mailbox 1 then is free to come through the windshield of the vehicle, with potentially fatal consequences for the vehicle's occupants.

Figure 3:
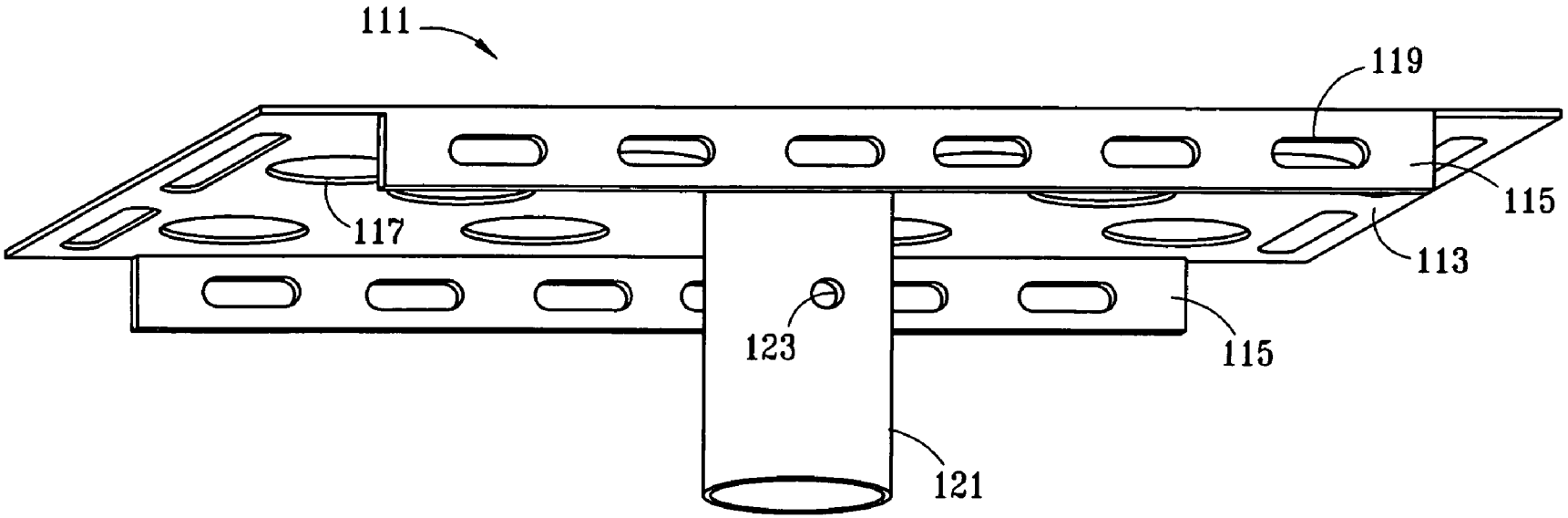
FIG. 3 is a perspective view of the mailbox bracket according to the present invention.
Figure 4:
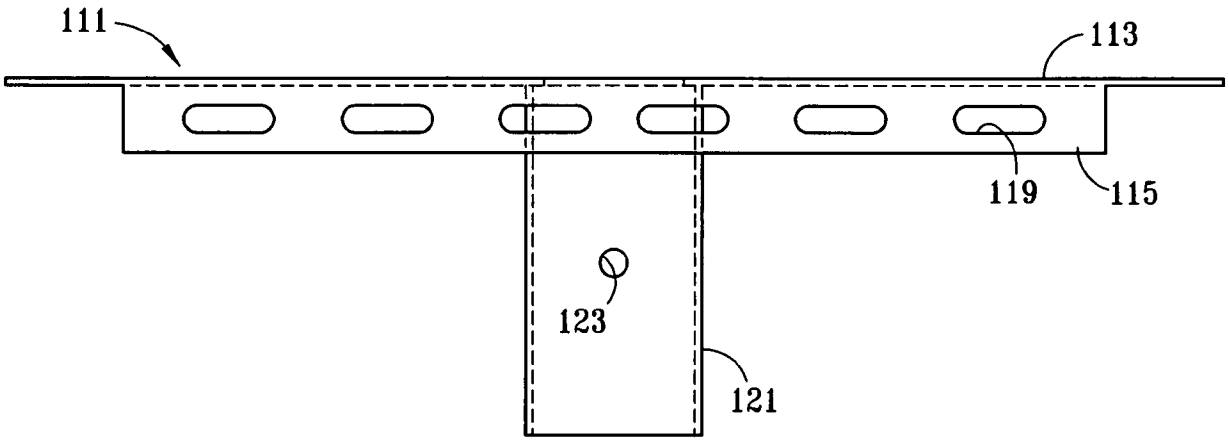
FIG. 4 is a plan view of the mailbox bracket of FIG. 3.
Figure 5:
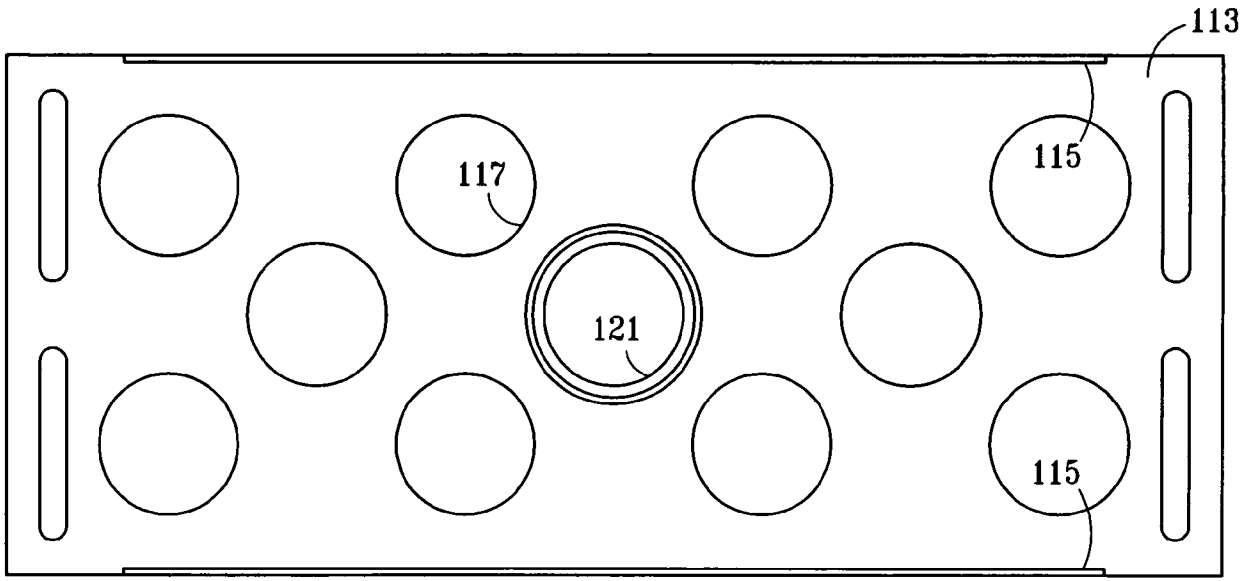
FIG. 5 is an elevation view of the mailbox bracket of FIGS. 3 and 4.

FIGS. 3, 4, and 5 are various views of mailbox bracket 111 according to the preferred embodiment of the present invention. This embodiment, as tested, seems to avoid the failure mode described above and is also adapted to receive a cylindrical (circular in cross section) post as described in commonly invented application Ser. No. 10/723,968, entitled SIGNPOST FORMED OF RECYCLED MATERIAL and filed Nov. 26, 2003, which is more aesthetically pleasing than the conventional post shown in FIG. 1. As shown, bracket 111 comprises a rectangular, generally laminar plate 113, which is generally coextensive with the bottom surface of mailbox 1 (it is not necessary that plate 113 be as long as mailbox, but must be as wide).

A pair of downwardly extending flanges 115 are formed on the long edges of plate 113 and are provided with a plurality of oblong holes 119 to facilitate mounting to the corresponding downwardly turned flanges on mailbox 1 by bolts (see FIG. 2). A plurality of lightening holes or apertures 117 are formed through plate 113 to save material and reduce the overall weight of bracket 115. A cylindrical sleeve 121 is secured to a central portion of plate 113 and extends downwardly therefrom in the same direction as flanges 115.

Sleeve 121 thus forms a socket adapted to receive a cylindrical post. An aperture 123 is provided in the wall of sleeve 121 and extends through both walls of sleeve 121. A corresponding aperture or hole in a post thus can be aligned with aperture 123 and a bolt or cotter pin (not shown) used to secure mailbox 1 and bracket 111 to the post and against rotation relative to the post.

According to the preferred embodiment of the present invention, plate 113 is formed from a sheet of 0.074 inch 14-gauge type A36 mild steel 121. Sleeve 121 preferably is formed of 2.5 inch O.D. by 0.065 inch wall thickness 1020 steel and is wire welded to plate 113 in a conventional manner. As illustrated, this forms a generally continuous (in both length and cross-section), one-piece, hollow cylindrical sleeve. These dimensions are given for a post having a nominal outer diameter of 2.375 inches. Dimensions will, of course, vary with the application.

In operation, mailbox 1 is placed atop plate 113 and holes 119 in flanges 115 are aligned with corresponding holes (not shown) in the flanges (FIG. 1) on mailbox 1. According to the preferred embodiment, bottom 9 of mailbox 1 then is in close proximity to plate 113. Bracket 111 and sleeve 121 are placed atop a cylindrical post and a bolt or pin used to secure them together. Testing indicates that the bracket as described herein avoids the potentially troublesome failure mode described above. It is also adapted to be used with a more aesthetically pleasing cylindrical post.

The invention has been described with reference to a preferred embodiment. It is thus not limited, but is susceptible to variation and modification without departing from the scope of the invention.

I claim:

1. A bracket for securing a mailbox to an upstanding post, the bracket comprising:

a rectangular plate defining a plane, the plate having an upper surface and a lower surface and a pair of long edges having a length and an end of the length and a pair of short edges, the upper surface of the plate being coextensive with and supporting a lower surface of a mailbox;

at least one flange on a long edge of the plate, the flange extending perpendicular to and downwardly from the lower surface of the plane of the plate;

the at least one flange extending along but less than the length of the long edge of the plate, leaving the end of the length free from the at least one flange at least one fastener securing the flange to the a mailbox;

a continuous and cylindrical sleeve secured in immediate physical contact to a central portion of the, lower surface of the plate and extending downwardly therefrom, the sleeve adapted to receive a cylindrical post; and a sleeve fastener for securing the post within the sleeve;

and wherein the plate is provided with a plurality of arcuate lightening holes.

2. The bracket according to claim 1 wherein the sleeve fastener further comprises:

an aperture formed through the sleeve and a post; and a bolt extending through the aperture, thereby securing the sleeve against movement relative to a post.

3. The bracket according to claim 1 wherein the fastener is a nut and a bolt.

4. A bracket for securing a mailbox to an upstanding post, the bracket comprising:

a rectangular plate having an upper surface and a lower surface and a pair of long edges and a pair of short edges, the upper surface of the plate being dimensioned to be generally coextensive with and adapted to support a lower surface of the a mailbox;

a plurality of lightening holes formed in the plate;

a flange extending along each long edge of the plate generally perpendicular to and downwardly from the lower surface of the plate, the flange having a length shorter than that of the plate, wherein the plate is free of the flange at each end thereof;

at least one fastener for securing the flanges to corresponding flanges on the mailbox;

a generally cylindrical, one-piece sleeve in immediate physical contact with a central portion of the lower surface of the plate and extending downwardly therefrom, the sleeve adapted to receive a generally cylindrical post; and a sleeve fastener for securing the a post within the sleeve.

5. The bracket according to claim 4 wherein the sleeve fastener further comprises:

an aperture formed through the sleeve and a post; and a bolt extending through the aperture, thereby securing the sleeve against movement relative to a post.

6. The bracket according to claim 4 wherein the fastener is a nut and a bolt.

* * * * *